US006087918A

United States Patent [19]

Henry et al.

[11] Patent Number: 6,087,918

[45] Date of Patent: Jul. 11, 2000

[54] TWIST LOCK IGNITION COIL

[75] Inventors: James Patrick Henry, Noblesville; Jeff A. King, Markleville; Jeffrey Dan Ogden, Anderson, all of Ind.

[73] Assignee: Delphi Technologies, Inc., Troy, Mich.

[21] Appl. No.: 09/420,739

[22] Filed: Oct. 20, 1999

[51] Int. Cl.[7] ..... H01F 27/02

[52] U.S. Cl. ..... 336/96; 336/90

[58] Field of Search ..... 336/90, 96

[56] References Cited

U.S. PATENT DOCUMENTS

| | | | |
|---|---|---|---|
| 4,903,674 | 2/1990 | Bassett et al. | 123/634 |
| 5,335,642 | 8/1994 | Hancock et al. | 123/634 |
| 5,577,764 | 11/1996 | Webber et al. | 280/728.2 |
| 5,706,792 | 1/1998 | Boyer et al. | 123/634 |
| 5,867,583 | 2/1999 | Hazelwood et al. | 381/395 |
| 5,870,012 | 2/1999 | Sakamaki et al. | 336/107 |

*Primary Examiner*—Michael L. Gellner
*Assistant Examiner*—Anh Mai
*Attorney, Agent, or Firm*—Margaret A. Dobrowitsky

[57] ABSTRACT

An ignition coil is secured to an internal combustion engine by a twist lock connection. The twist lock connection is defined by a first connection feature comprising a plurality of tabs extending radially outwardly from a cylindrical body portion of the ignition coil, and a second connecting feature comprising a corresponding plurality of camming surfaces having a ramp shape and terminating in a mechanical stop.

12 Claims, 3 Drawing Sheets

TWIST LOCK IGNITION COIL

BACKGROUND OF THE INVENTION

1. Technical Field

The present invention relates generally to an ignition coil for an internal combustion engine ignition system and, more particularly, to a twist lock ignition coil.

2. Discussion of the Related Art

Ignition coils for providing a spark to a combustion chamber of an internal combustion engine are generally known. Further, various arrangements for securing the ignition coil to a vehicle driven by the engine are also known, as seen by reference to U.S. Pat. No. 5,870,012 to Sakamaki et al. Sakamaki et al. disclose an ignition coil of a relatively slender configuration that is mounted directly above a spark plug. Such ignition coil is disposed in a cylindrical bore in a cylinder head portion of the engine, and is secured at a flange portion of the ignition coil to the cylinder head with a bolt through a hole in the flange. This configuration requires an extra step in the manufacturing process (i.e., to secure the ignition coil using the bolt), requires a greater number of parts (e.g., bolt), and also requires additional space in the engine compartment to accommodate the above-described flange.

There is therefore a need to provide an improved ignition coil configuration, and more particularly an arrangement for securing an ignition coil to an engine, that minimizes or eliminates one or more of the shortcomings as set forth above.

SUMMARY OF THE INVENTION

A twist lock ignition coil in accordance with the present invention is characterized by the features specified in claim 1.

An arrangement of an ignition system for an internal combustion engine in accordance with the present invention includes a "twist lock" connection feature that allows the elimination of fasteners and retainers which are used in conventional arrangements. In addition, the invention simplifies the production process by eliminating the step of installing the fastener. Moreover, an ignition coil used in a connection arrangement in accordance with the invention does not use as much space in the engine compartment inasmuch as a conventional flange, boss, or the like for the fastener is not required. Finally, the invention minimizes or eliminates axially movement of the coil due to, for example, vibration.

An arrangement is provided for securing an ignition coil to an internal combustion engine having a spark plug wherein the engine includes a cylindrical bore having an inner surface; the bore providing access to the spark plug, the ignition coil having a main axis and a body portion; characterized by a first connecting feature disposed on a body portion of the ignition coil and a second connecting feature disposed on the inner surface of the bore that is complementary with the first connecting feature wherein the first and second connecting features define a twist lock connection for mounting the ignition coil to the engine.

In a preferred embodiment, the first connecting feature may also include a plurality of tabs projecting radially outwardly from a generally cylindrical outer surface of the body portion of the ignition coil. Also in a preferred embodiment, the second connecting feature may also include at least first and second camming surfaces respectively facing in axially-opposed directions for engagement by the tabs for maintaining the ignition coil in a substantially fixed axial position.

BRIEF DESCRIPTION OF THE DRAWINGS

The present invention will now be described by way of example, with reference to the accompanying drawings, in which.

DETAILED DESCRIPTION OF THE PREFERRED EMBODIMENTS

Figure 1:
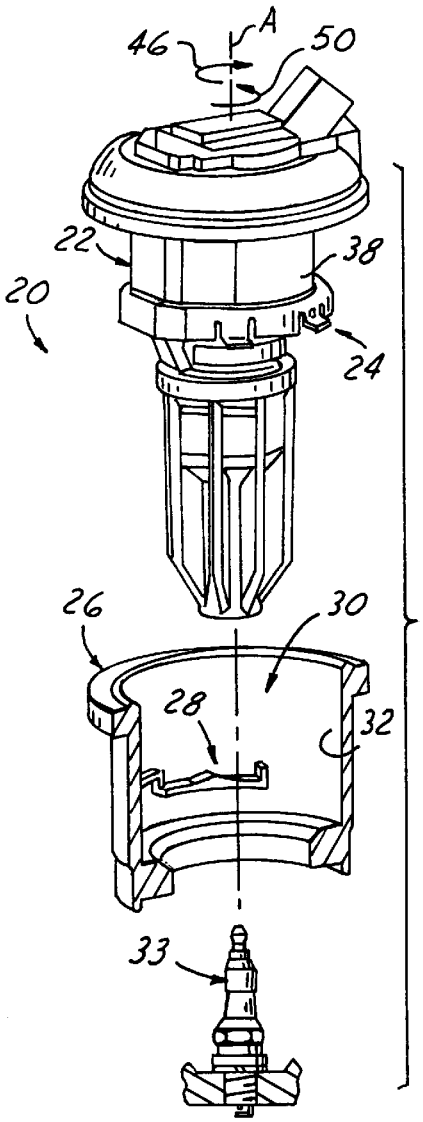
FIG. 1 is a simplified, perspective, exploded view of an arrangement for securing an ignition coil in accordance with the present invention.

Referring now to the drawings wherein like reference numerals are used to identify identical components in the various views, FIG. 1 is an exploded, perspective view of an arrangement 20 for securing an ignition coil 22 to an internal combustion engine. In accordance with the present invention, a "twist lock" connection feature is provided for simplified mounting, which eliminates the need for fasteners/retainers that are conventionally used. The "twist lock" connection also improves space usage in the engine compartment by not requiring a flange, boss, or the like on the ignition coil, as conventionally employed to receive the retaining bolt.

Before proceeding to a detailed description, a brief, general statement of the simplicity of installation provided by the present invention will be set forth. Ignition coil 22 is first disposed in bore 30 in an insertion position wherein ignition coil 22 is positioned relative to the housing 26. In the insertion position, a spring-biased high voltage contact or the like, which is conventionally a part of ignition coil 22 on a lower-most region thereof, engages a high voltage terminal on spark plug 33. The assembly operator thereafter rotates the ignition coil in a first direction about main axis A away from the insertion position toward a locking position. First and second connecting features 24, and 28 engage and cooperate to form a "twist lock" connection. In the locking position, the first and second connecting features together oppose rotation of the coil in a second direction opposite the first direction, and further, oppose any axial movement of coil 22.

Ignition coil 22 may be generally cylindrical in shape, having a main axis designated "A" in the drawings. As known, coil 22 provides a relatively high voltage to plug 33, upon command, to initiate a spark.

First connecting feature 24 associated with ignition coil 22 is configured to be complementary with the second connecting feature 28 associated with housing 26 to form the "twist lock" connection. In one embodiment, first connecting feature 24 is formed from a strap 34 comprising a plurality of tabs 36 (best shown in FIG. 3). More particularly, strap 34 is configured in size and shape to be connected to a central body portion 38 of ignition coil 22 such that tabs 36 project radially outwardly therefrom. In a preferred embodiment, strap 34 comprising tabs 36 is formed of metal, and may be formed as a stamped part. Strap 34 is attached to coil 22 by, for example, welding, or any other conventional and known attachment process. Thus connected, tabs 36 each extend circumferentially a predetermined amount. However, it should be understood that tabs 36 need not be separately provided by way of strap 34, but rather, may be a feature integrated with coil 22 itself.

Housing 26, in a preferred embodiment, comprises a portion of the engine, such as the cylinder head, or in a preferred embodiment a camshaft cover housing. Housing 26 includes cylindrical bore 30 that is defined by inner surface 32. Bore 30 provides access to a spark plug hole in the engine that is in communication with the combustion chamber. Housing 26 may be formed of various materials, such as, plastic, or metal (e.g., aluminum or magnesium).

Second connecting feature 28 associated with housing 26 comprises, in the illustrated embodiment, at least first and second camming surfaces 40, and 42. First and second camming surfaces 40, and 42, as illustrated, may each include a ramp-like shape. Surfaces 40, 42 respectively face in axially-opposed directions. Surfaces 40, 42 are preferably configured to be engaged by tabs 36 in such a way so as to maintain ignition coil 22 in a substantially fixed axial position when in a locking position. The locking position will be described in further detail hereinafter.

Figure 2:
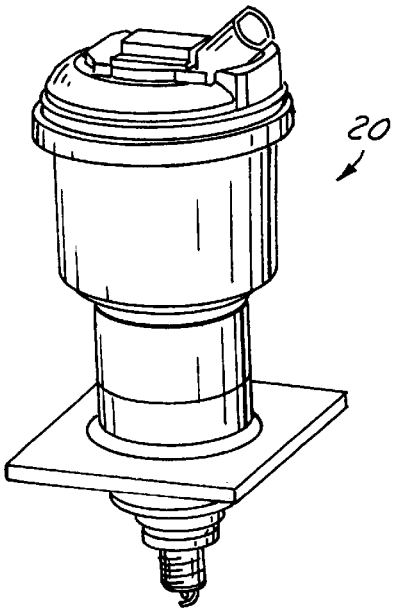
FIG. 2 is the arrangement illustrated in FIG. 1 in an assembled condition.

FIG. 2 shows arrangement 20 in a completely assembled condition. In FIG. 2, portions of the engine have been omitted for clarity.

Figure 3:
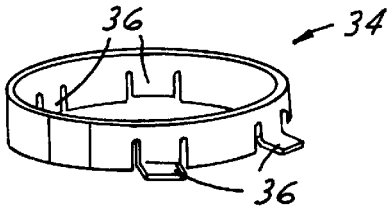
FIG. 3 is a simplified, perspective view showing a first connecting feature comprising tabs configured to be disposed on the ignition coil of FIG. 1.

FIG. 3 shows strap 34 in perspective. Tabs 36 may be disposed so as to establish a predetermined orientation between coil 22 and the housing 26. That is, the tabs 36 are not uniformly spaced around the periphery of strap 34 so as to permit the insertion of coil 22 (with strap 34 attached) in any one of a plurality of positions relative to housing 26. Rather, a first group of tabs 36 (e.g., the tabs facing frontward in FIG. 3) are relatively closely spaced, as are a second group of tabs 36 (e.g., the tabs facing rearward in FIG. 3). The first and second groups, however, are spaced relatively further apart than the distance between the tabs of a tab group.

Figure 4A:
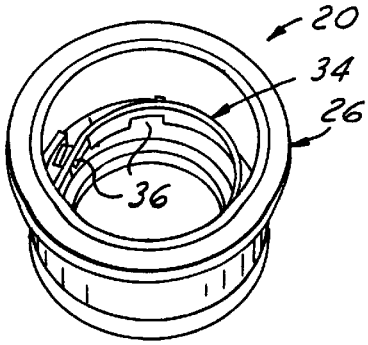
FIGS. 4A–4B are simplified perspective and plan views, respectively, showing the cooperation of the first and second connecting features in accordance with the present invention (the ignition coil being omitted for clarity)

FIG. 4A shows arrangement 20 in a locking position (coil 22 being omitted for clarity), with the tabs 36 engaging the camming surfaces.

Figure 4B:
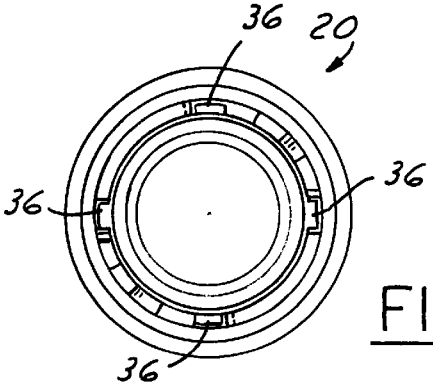

FIG. 4B shows arrangement 20 in an insertion position, with the tabs positioned in insertion windows.

Figure 5A:
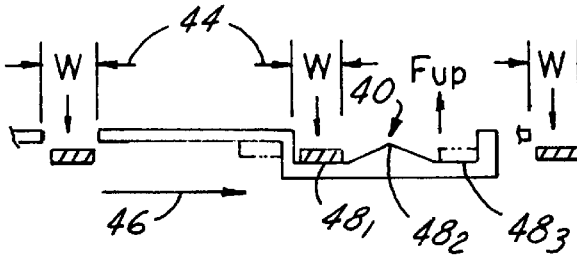
FIGS. 5A–5B are simplified, diagrammatic views showing a twist lock connection feature in an insertion position, and in a locking position (phantom-line format)
Figure 5B:
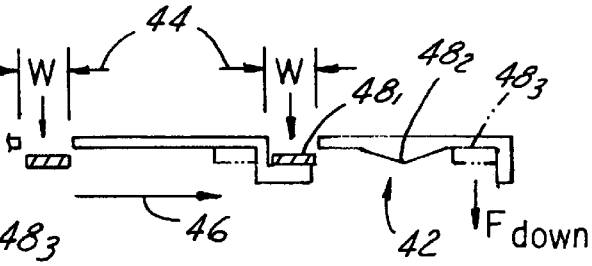

FIGS. 5A and 5B are simplified diagrammatic illustrations showing features and operation of the invention in greater detail. In FIGS. 5A and 5B, four tabs 36 are shown in a section view format—the tabs are illustrated in an insertion position 481. In insertion position 481, ignition coil 22 is disposed in bore 30 until tabs 36 seat on portions of the camming surfaces 40, 42. Tabs 36 enter through a plurality of insertion windows 44 that are sized to accommodate tabs 36. Tabs 36 and camming surfaces 40, and 42, engage and cooperate to position coil 22 relative to housing 26. Ignition coil 22 is rotatable in a first direction 46 (the direction 46 also shown in FIG. 1) about main axis "A" away from insertion position 481, through intermediate position 482 to a locking position 483. The locking position 483 is represented in FIGS. 5A and 5B by the four tabs 36 that are drawn in phantom-line format. That is, after insertion, further rotation of ignition coil 22 in direction 46 causes tabs 36 to reach the position designated 482. Still further rotation causes tabs 36 on camming surfaces 40, and 42 to "snap down" and reach locking position 483. It should be understood that the relative orientation of direction 46 (e.g., clockwise as viewed from the top) is arbitrary; direction 46 could also be counter-clockwise (CCW) with minor changes to the camming surfaces.

In the illustrated embodiment, second connecting feature 28 may also include a plurality of stop features 52 which are configured to limit rotation of ignition coil 22 in first direction 46 by providing a mechanical stop when the ignition coil is rotated to locking position 483. In locking position 483, first and second connecting features 24, and 28 (i.e., the respective tabs 36 and camming surfaces described and illustrated in this embodiment) cooperate to oppose rotation of ignition coil 22 in a second direction 50 (the direction 50 best shown in FIG. 1) opposite first direction 46. This is due to the upwardly sloping portion of surfaces 40, 42 as taken from locking position 483 to position 482, which interferes with the movement of tabs 36 in direction 50. The interference may be overcome by applying sufficient force to cause tab 36 to deform to "ride" back over the ramp. In addition, axial movement (relative to axis "A") is also reduced. The tabs 36 on strap 34, as attached to ignition coil 22, and, the camming surfaces 40, 42 on inner surface 32 of housing 26, are formed so as to provide an "interference" between the tabs and the camming surfaces. That is, camming surface 40 is disposed so as to face generally, axially, upwardly, while the camming surface 42 is disposed so as to face generally, axially, downwardly. With the above-described "interference," tab 36 on camming surface 40, when in locking position 483, is deformed upwardly from its repose position, thereby exerting an axially upward force "FUP" on coil 22 through strap 34. Likewise, tab 36 on surface 42, when in a locking position 483, is deformed downwardly from its repose position, thereby exerting an axially downward force "FDOWN" on ignition coil 22 through strap 34. These forces cooperate so as to minimize or eliminate substantially, any axial movement of coil 22 relative to housing 26.

Figure 6A:
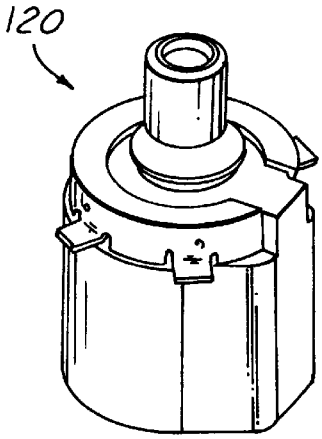
FIGS. 6A–6B are simplified, perspective views showing an alternate embodiment in assembled and exploded conditions, respectively.
Figure 6B:
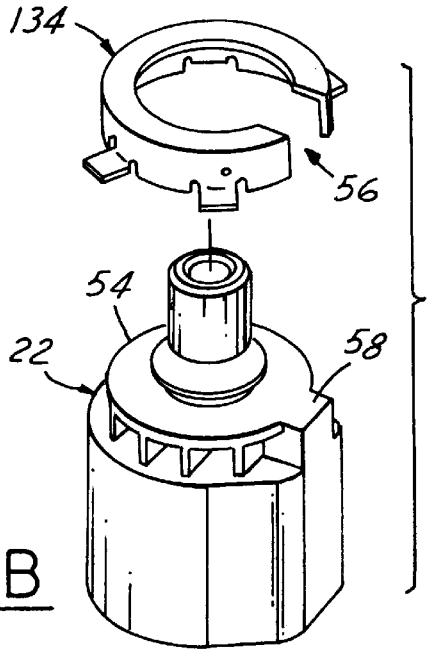

FIGS. 6A–6B show an alternate arrangement 120 for mounting ignition coil 22 to an engine which features an alternate strap 134. FIG. 6A shows arrangement 120 in an assembled state; FIG. 6B in an exploded, unassembled state. In the illustrated embodiment, ignition coil 22 has a reduced diameter portion 54. The diameter of strap 134 is reduced accordingly. In addition, strap 134 includes a circumferentially–extending space or opening 56 configured in size and shape to receive a corresponding feature 58 on coil 22. It should be understood that strap 34 shown in FIG. 3, and strap 134 shown in FIGS. 6A and 6B, are but two of the numerous variations that are possible in view of the corresponding variations in ignition coil geometries known to those of ordinary skill in the art. In all other respects, strap 134 is the same as strap 34, other than the noted geometrical variation.

Figure 7A:
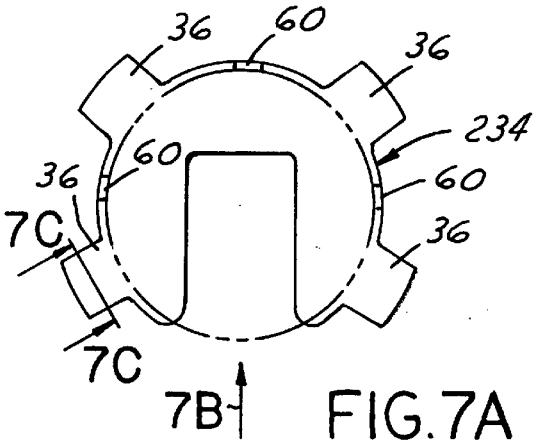
FIGS. 7A–7C are simplified top plan, side plan, and section views, respectively, of another embodiment including an electrical grounding finger feature.
Figure 7C:
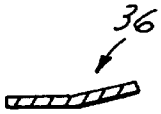
Figure 7B:
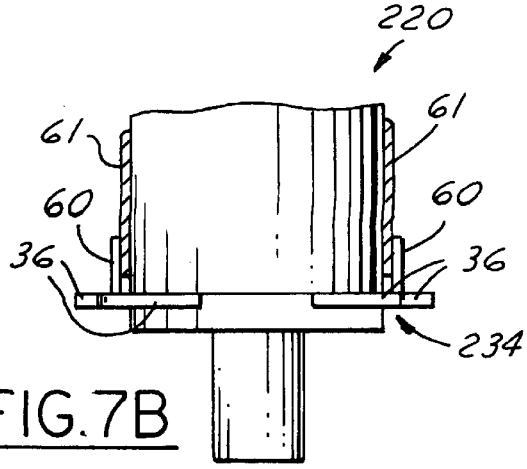

FIGS. 7A–7C show yet another alternate arrangement 220 for mounting an ignition coil 22 to an internal combustion engine. In particular, FIGS. 7A–7C further show another embodiment of strap 34, namely strap 234. Strap 234 is the same as strap 134, except that it further includes a plurality of grounding fingers 60 disposed around an outside diameter portion of strap 234. As shown in FIG. 7A, each grounding finger 60 is circumferentially spaced from each other. As shown in FIG. 7B, each finger 60 extends in an axial direction for a predetermined distance. The fingers 60 are configured to electrically couple a shield portion 61 of ignition coil 22 to ground. To accomplish this function, strap 234 is electrically conductive, preferably metal, and is connected to a portion of ignition coil 22 that is grounded through a separate, preferably internal, electrical connection (not shown). The configuration shown in FIGS. 7A–7C eliminates the need for an internal grounding terminal or the like configured to contact and ground shield portion 61. FIG. 7C shows a section through tab 36, illustrating a deformation thereof.

Figure 8A:
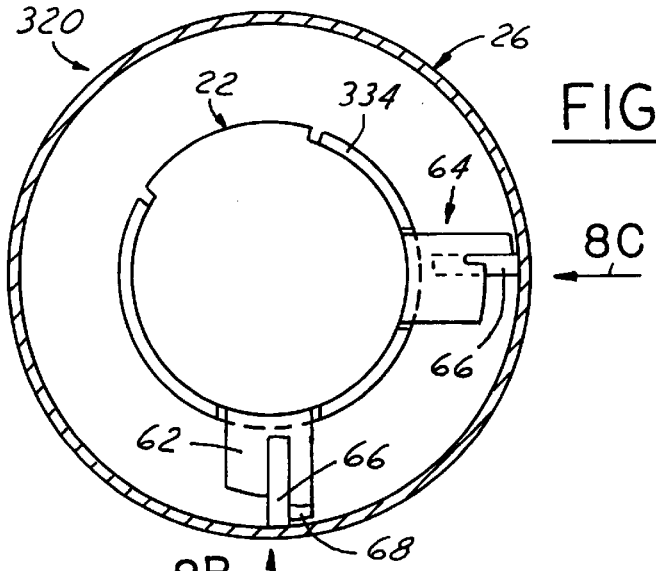
FIGS. 8A–8C are simplified top, front and right side plan views of still another embodiment according to the invention.
Figure 8C:
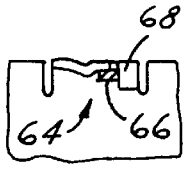
Figure 8B:
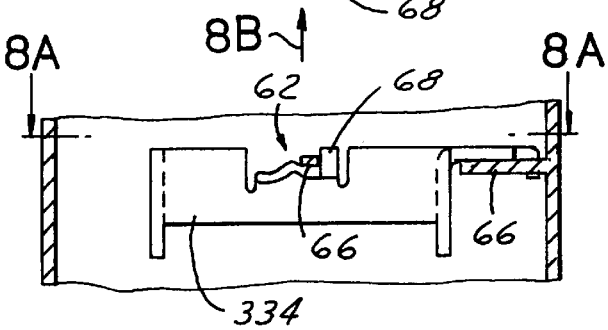

FIGS. 8A–8C show still yet another alternate arrangement 320 for mounting an ignition coil to an internal combustion engine. FIG. 8A is a top view of arrangement 320, shown partially in section. FIG. 8B is a partial section view looking in the direction of the arrow designated "8C" in FIG. 8A, with portions broken away. FIG. 8C is a partial section view looking in the direction of the arrow designated "8C" in FIG. 8A, with portions broken away. In the embodiment of FIGS. 8A–8C, the relative positions of the tabs/camming surfaces are switched. Therefore, (i) the first connecting feature 24 associated with coil 22 includes first and second camming surfaces 62, and 64 respectively facing in axially-opposed directions, and (ii) the second connecting feature 28 associated with housing 26 includes a plurality of tabs 66 projecting radially inwardly from inner surface 32, and extending circumferentially a predetermined amount. FIG. 8A in particular shows another embodiment of strap 34, namely strap 334. Strap 334 includes the camming surfaces 62 and 64. Tabs 66 engage and cooperate with the camming surfaces 62, 64 to provide a "twist lock" connection of ignition coil 22 to housing 26. The first connecting feature 24 of arrangement 320 also includes a plurality of stop features 68 projecting outwardly from body portion 38. Stop feature 68 is configured to limit rotation of ignition coil 22 in the first direction 46 (i.e., the direction in which the ignition coil was twisted to achieve the secure mounting) when ignition coil 22 is in the above–described locking position 483.

Figure 9A:
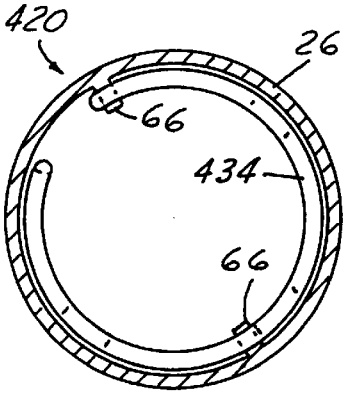
FIGS. 9A–9C are simplified top, side, and section views showing still yet another embodiment in accordance with the present invention; and, FIGS. 10A–10B are simplified front and top plan views, partially in section, showing a fifth embodiment in accordance with the present invention.
Figure 9B:
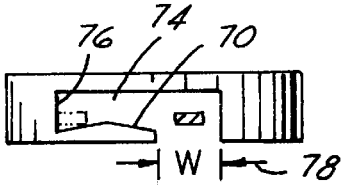
Figure 9C:
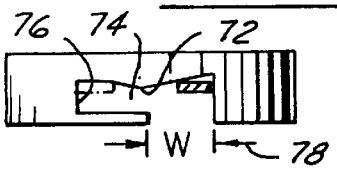

FIGS. 9A–9C show yet another alternate arrangement 420 for mounting an ignition coil 22 to an internal combustion engine. The embodiment of FIGS. 9A–9C, like the embodiment of FIGS. 8A–8C, but unlike the embodiments of FIGS. 1–7C, reverses the relative orientation of the tabs/camming surfaces (e.g., the tabs extend inwardly from the housing). FIG. 9A is a top partial-section view of arrangement 420 with portions broken away. FIGS. 9B and 9C are partial section views of the arrangement of FIG. 9A, with portions broken away. In arrangement 420, housing 26 includes two tabs 66, while a strap 434 includes first and second camming surfaces 70, and 72 respectively facing in axially opposed directions. Camming surfaces 70, and 72 are formed in respective channels 74 which terminate in respective stop features 76. Tabs 66 gain access to camming surfaces 70, and 72 by way of insertion windows 78 sized to accommodate tabs 66. The tabs 66 shown in section-view format are in the insertion position while the tabs shown in phantom-line format are in the locking position (after rotation).

Figure 10A:
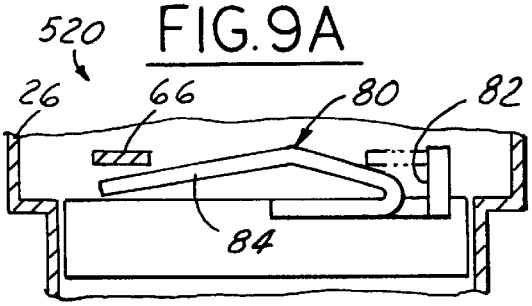
Figure 10B:
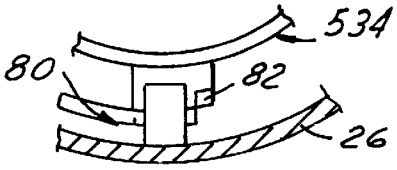

FIGS. 10A–10B show yet another alternate arrangement 520 for mounting an ignition coil 22 to an internal combustion engine. The embodiment shown in FIGS. 10A–10B is similar to the embodiment shown in FIGS. 8, and 9 (i.e., radially, inwardly projecting tabs with radially, outwardly disposed camming surfaces/stop features). Arrangement 520 includes a pair of tabs 66, projecting radially inwardly from an inner surface 32 of housing 26. In addition, arrangement 520 includes another embodiment of strap 34, namely strap 534, that has a pair of camming surfaces 80 (only one shown) which each include a respective stop feature 82. Each of the two camming surfaces in this embodiment are formed using a respective spring tab 84, and engage a respective one of tabs 66. In all other respects, arrangement 520 operates and functions the same as the foregoing-described embodiments.

It is to be understood that the above description is merely exemplary rather than limiting in nature, the invention being limited only by the appended claims. Various modifications and changes may be made thereto by one of ordinary skill in the art which embody the principles of the invention and fall within the spirit and scope thereof.

We claim:

1. An arrangement for securing an ignition coil to an internal combustion engine having a spark plug wherein the engine includes a cylindrical bore having an inner surface, the bore providing access to the spark plug, the ignition coil having a main axis and body portion, characterized by:

a first connecting feature disposed on the body portion of the ignition coil, and, a second connecting feature disposed on the inner surface of the cylindrical bore that is complementary with the first connecting feature, the first and second connecting features defining a twist lock connection for mounting the ignition coil (22) to the engine.

2. The arrangement of claim 1 further including an insertion position and a locking position, wherein in the insertion position the ignition coil is disposed in the cylindrical bore and the first and second connecting features engage and cooperate to position the ignition coil relative to the engine, the ignition coil being rotatable in a first direction about the main axis from the insertion position to the locking position wherein the first and second connecting features oppose rotation of the ignition coil in a second direction opposite the first direction and further oppose axial movement of the coil.

3. The arrangement of claim 2 wherein the first connecting feature comprises a plurality of tabs projecting radially outwardly from a generally cylindrical outer surface of the body portion of the ignition coil and each extending circumferentially a predetermined amount; and, wherein the second connecting feature includes at least first and second camming surfaces respectively facing in axially-opposed directions for engagement by the tabs for maintaining the ignition coil in a substantially fixed axial position.

4. The arrangement of claim 2 wherein the second connecting feature comprises a plurality of tabs projecting radially inwardly from the inner surface of the cylindrical bore and extending circumferentially a predetermined amount; and, wherein the first connecting feature includes at least first and second camming surfaces respectively facing in axially-opposed directions for engagement by the tabs for maintaining the ignition coil in a substantially fixed axial position.

5. The arrangement of claim 4 wherein the first connecting feature further includes a plurality of stop features projecting from the body portion of the ignition coil configured to limit rotation of the ignition coil in the first direction when the ignition coil is in the locking position.

6. The arrangement of claim 5 wherein the camming surfaces are disposed in respective channels accessible to the tabs through a plurality of insertion windows corresponding to the plurality of tabs.

7. The arrangement of claim 4 wherein the first and second camming surfaces are defined by respective spring tabs.

8. The arrangement of claim 3 wherein the second connecting feature includes a plurality of stop features projecting from the inner surface configured to limit rotation of the ignition coil in the first direction when the ignition coil is in the locking position.

9. The arrangement of claim 8 wherein the second connecting feature includes a plurality of insertion windows corresponding to the plurality of tabs.

10. The arrangement of claim 3 wherein the first connecting feature further comprises an electrically conductive strap from which the tabs project, the first connecting feature further including at least one finger projecting from the strap and axially extending upwardly for a predetermined length, the ignition coil including an electrically conductive shield portion, the finger configured to electrically couple the shield portion and the strap.

11. The arrangement of claim 10 wherein the strap is electrically connected to a ground node, the at least one finger being operative to ground the shield portion.

12. The arrangement of claim 3 wherein the first connecting feature further comprises a strap from which the tabs project, the strap having a circumferentially-extending opening configured to receive a corresponding feature disposed on the ignition coil.

* * * * *